US005237847A

United States Patent [19]

Owens

[11] Patent Number: 5,237,847

[45] Date of Patent: Aug. 24, 1993

[54] TUBE BENDING APPARATUS

[76] Inventor: Carl H. Owens, 5800 France Ave., Jacksonville, Fla. 32205

[21] Appl. No.: 882,821

[22] Filed: May 14, 1992

[51] Int. Cl.[5] ..... B21D 9/08

[52] U.S. Cl. ..... 72/213; 72/389

[58] Field of Search ..... 72/213, 212, 389, 386, 72/217

[56] References Cited

U.S. PATENT DOCUMENTS

| | | | |
|---|---|---|---|
| 1,505,887 | 8/1924 | Hawes | 72/217 |
| 1,530,261 | 3/1925 | Hawes | 72/217 |
| 2,880,779 | 4/1959 | Minguri | 72/213 |
| 3,018,818 | 1/1962 | Swanson | 72/213 |
| 3,448,602 | 6/1969 | Stanley et al. | 72/217 |
| 3,908,425 | 9/1975 | Ware | 72/217 |
| 4,005,593 | 2/1977 | Goldberg | 72/213 |

FOREIGN PATENT DOCUMENTS

| | | | |
|---|---|---|---|
| 3711970 | 10/1988 | Fed. Rep. of Germany | 72/389 |
| 0132320 | 8/1983 | Japan | 72/217 |

*Primary Examiner*—Lowell A. Larson
*Assistant Examiner*—Michael J. McKeon
*Attorney, Agent, or Firm*—Thomas C. Saitta

[57] ABSTRACT

A tube bending apparatus is presented having a bending shoe, two lateral rollers to receive the tubular workpiece, reciprocating power means to advance and retract the bending shoe between the lateral rollers, and a base. The bending shoe has a semi-circular bending channel with lips extending from the top and bottom of the bending channel on the forward portion of the bending shoe, whereby the lips extend beyond the midpoint of the tubular workpiece being bent to prevent crimping or folding. The lateral rollers are mounted in slots in the base to allow for multiple positions.

3 Claims, 2 Drawing Sheets

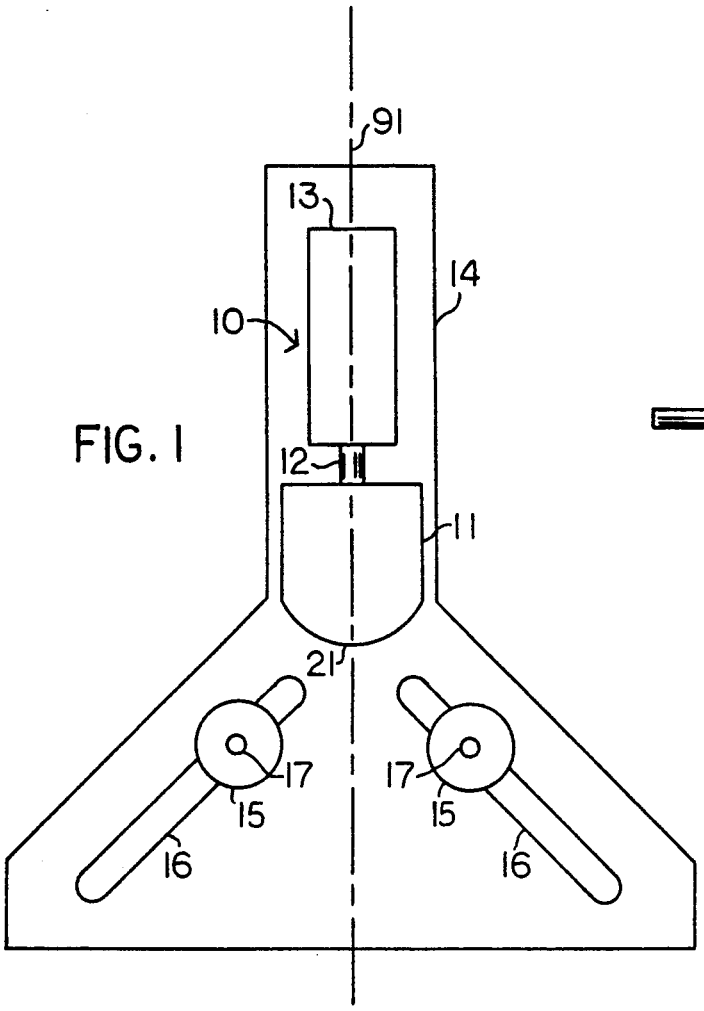
FIG. 1
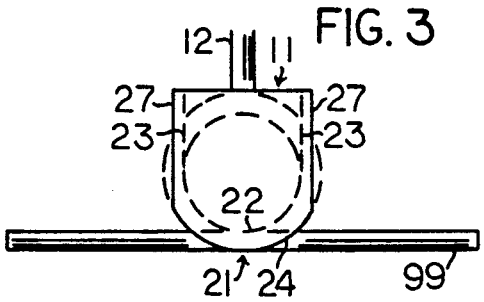
FIG. 3
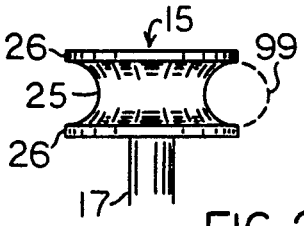
FIG. 2
FIG. 4
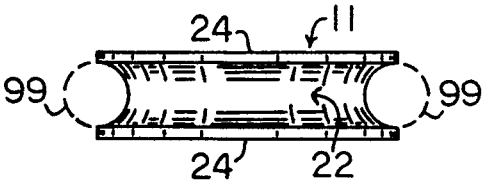
FIG. 5
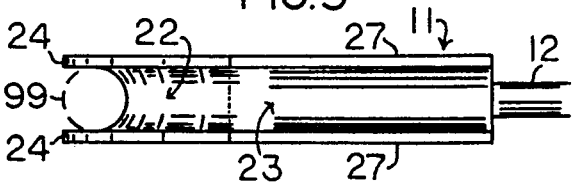
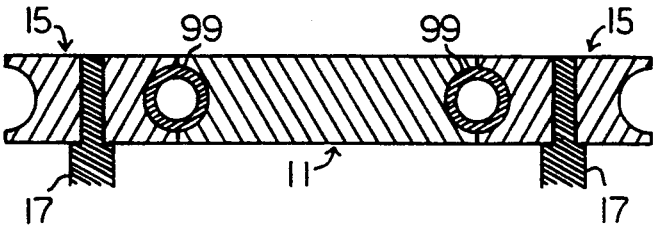
FIG. 6

TUBE BENDING APPARATUS

BACKGROUND OF THE INVENTION

This invention relates generally to the field of tube bending devices which utilize a reciprocating ram member to move a bending shoe relative to two fixed workpiece holding rollers. More particularly, the invention relates to such devices capable of imparting a bend in the tubular workpiece of up to 180 degrees.

Apparatus for cold bending tubes or pipes are well known in the art. A typical device incorporates a bending shoe mounted onto a reciprocating ram or piston, the ram being advanced either mechanically or hydraulically. The bending shoe has a semi-circular configuration on the forward portion of its workpiece meeting face and parallel straight portions extending behind the semi-circular portion, with a workpiece receiving channel concave in cross-section extending around the workpiece meeting perimeter in a U-shape. A pair of workpiece holding rollers are mounted in a fixed relation to the bending shoe, one on each side of the bending shoe. Each roller has a receiving channel concave in cross-section for holding the tubular workpiece. The bending channel in the bending shoe and the receiving channels in the rollers are semi-circular in vertical cross-section and are sized to match the outer diameter of the tubular workpiece being bent in the device, with the channel not exceeding one-half the diameter of the tube in depth. The rollers are fixedly mounted on a base or other housing member such that the outer lips of the straight portions on each side of the bending shoe contact the outer lips of each of the rollers when the bending shoe is advanced between the two rollers. In this manner the bending shoe channel and the roller channel will completely encircle the tube being bent 180 degrees, thus preventing crimping or folding of the tube.

Examples of such devices are shown in U.S. Pat. No. 2,880,779 to Mingori and U.S. Pat. No. 3,018,818 to Swanson. Other known devices for bending tubes use a fixed bending shoe and reciprocating rollers, such as is shown in U.S. Pat. No. 3,073,372 to Lang. A problem often occurs in these devices, especially when bending tubes made of relatively soft metal or of small diameter, in that crimping or folding occurs at the central bending point. This can occur if the tube moves sightly away from the bending shoe during the operation, in which case the lip of the semi-circular receiving channel no longer encases the tube to its center line. One solution to solve this problem is shown in U.S. Pat. No. 4,005,593 to Goldberg. This device incorporates a clamp which is positioned at the apex of the bending shoe, thus completely encircling the tube being bent at the central bending point.

This invention addresses the problem of preventing crimping in small tubes during cold bending without requiring an extra attachment to be affixed to the bending apparatus. It has been discovered that extending the lip of the receiving channel on the bending shoe in the area of the bending apex prevents crimping resulting from separation of the tube from the channel. The extended lip is not maintained around the full 180 degree face of the bending shoe, but is truncated on both sides so that there is no extension of the lip at the straight side portions. This allows the lips of the holding rollers to make contact with the lips of the bending shoe along the side portions in order to completely encircle the tube when the tube is fully bent.

It has also been discovered that the problem of crimping can be overcome by utilizing channels in the bending shoe and rollers which are slightly smaller in size than the outer diameter of the tube being bent, rather than matching the outer diameter of the tube as is commonly practiced. The pressure against the tube during the early advancement of the bending shoe ram forces it to adapt to the smaller diameter of the channel, imparting compressive forces in the region of the tube undergoing the bending deformation.

To accommodate tubes of different sizes, it is necessary that the bending shoe and rollers be detachable to allow selection of elements having the correctly sized channel to match the particular tube diameter. It is also necessary to provide multiple mounting positions for the rollers on the housing or base plate to account for both the tube size and the degree of bend desired. The common solution for mounting the rollers is to provide a number of apertures at selected locations to correspond to particular pipe sizes. This is an obvious drawback in that the user is limited to the predetermined positions. Should the user need to custom bend a pipe a certain number of degrees over a given range, the apparatus may not have the proper apertures for positioning the rollers correctly.

To solve this problem, the invention comprises two continuous slots cut into the baseplate or housing, one corresponding to each roller. Thus each roller can be positioned at any point within the slot, so that the device is usable to bend a tube into any desired arc.

It is an object of this invention to provide a tube bending apparatus suitable for bending small or soft material tubing up to 180 degrees without crimping, the improvement being an extended lip on the workpiece receiving channel on the forward portion of the bending shoe.

It is a further object to provide such an apparatus where the workpiece holding rollers are positionable over a continuous range of positions rather than at predetermined locations.

It is a further object of the invention to provide such an apparatus where the inner diameter of the receiving channel on the bending shoe is slightly smaller than the outer diameter of the tube being bent.

BRIEF SUMMARY OF THE INVENTION

The invention is a tube bending apparatus comprising a bending shoe mounted onto a reciprocating piston, the bending shoe being movable relative to two fixed position workpiece holding rollers, whereby the bending shoe is advanced between the two rollers to impart a bend of up to 180 degrees on a tubular workpiece positioned between the bending shoe and the rollers. The rollers are adapted to be laterally positioned relative to the bending shoe such that the lips of the rollers will be in contact with the lips on the sides of the bending shoe when the ram is fully advanced. The bending shoe and the rollers have concave channels to hold the tubular workpiece, the channel being U-shaped on the bending shoe and annular on the rollers.

The bending shoe has a curved configuration on the forward portion on its workpiece meeting face and a workpiece bending channel, concave and semi-circular in vertical cross-section. Parallel lips extend outwardly from the top and bottom endpoints of the semicircle of the bending channel. The lips preferably extend a distance equal to the radius of the semi-circular portion of the channel, such that the distance from the most interior point of the channel to the end of the extended lips equals the outer diameter of the tube being bent. The extended lips are truncated on each side of the bending shoe where they meet the lateral lips. The lateral lips have straight edges and are parallel to each other and to the central axis in the reciprocating direction of the bending shoe. This truncation allows each roller to contact the bending shoe to completely encircle the tube during the full bending operation.

The vertical diameter of the receiving channel of the bending shoe is sized approximately one-thousandth to two-thousandths of an inch smaller than the outer diameter of the tube being bent. When the bending shoe is forced against the tube, the tube is compressed in the vertical direction. This compression prevents the tube from crimping or folding during the bending operation.

The piston reciprocating mechanism is mounted onto a base or housing. Two slots are cut into the base or housing at angles of 45 degrees to the reciprocating direction and the rollers are positionable at any point along these slots. This allows the operator to bend a tube to any desired arc.

BRIEF DESCRIPTION OF THE DRAWINGS

FIG. 1 is a top view of the invention.

FIG. 2 is a side view of one of the lateral rollers.

FIG. 3 is a top view of a portion of the invention showing the bending shoe and tubular workpiece.

FIG. 4 is an end view of the bending shoe.

FIG. 5 is a side view of the bending shoe.

FIG. 6 is a cross-sectional view taken along line VI—VI of FIG. 9.

DETAILED DESCRIPTION OF THE INVENTION

Figure 9:
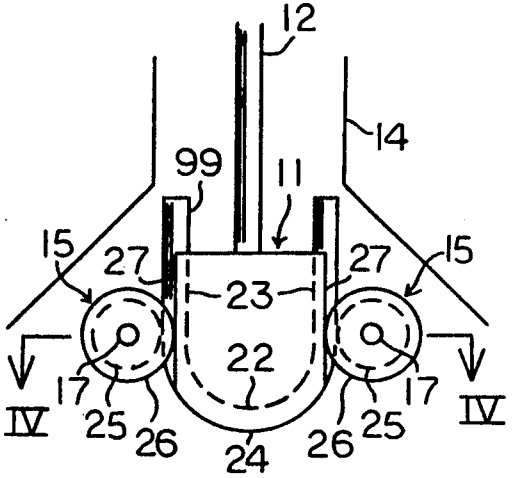
FIG. 9 is a top view of a portion of the invention in the finished bending position, showing the bending shoe, tubular workpiece and rollers.

With reference to the figures, the invention will now be described in terms of the best mode and preferred embodiment. The invention generally comprises a reciprocating ram member 10 and two lateral rollers 15 mounted onto a base 14, as shown in FIG. 1. Ram member 10 is comprised of a bending shoe 11, a piston 12 and a reciprocating power means 13. Ram member 10 is fixedly attached to base 14 in a manner which allows bending shoe 11 to be advanced and retracted along the reciprocating axis 91. The two lateral rollers 15 are mounted in slots 16 in base 14 and can be positioned at any point along slots 16. Base 14 can be part of a larger housing or can be as simple as a planar piece of metal where portability is desired.

The reciprocating power means 13 can be of any type known in the art whereby a sufficiently strong force can be applied in the forward reciprocating direction. For example, reciprocating power means 13 can be a hydraulic cylinder or a mechanical screw device, either powered or manually advanced. Reciprocating power means 13 advances piston 12 and bending shoe 11 along the reciprocating axis 91 to bend a tubular workpiece 99 positioned between bending shoe 11 and lateral rollers 15.

Referring now to FIG. 2, one of the lateral rollers 15 is shown with receiving channel 25 and roller receiving lips 26. Lateral rollers 15 are circular in configuration with an annular receiving channel 25 extending fully around the circumference. Receiving channel 25 is semi-circular in vertical cross-section and is adapted to receive and correspond to the outer circumference of a circular tubular workpiece 99. Roller lips 26 provide a meeting surface to contact bending shoe 11. Roller lips 26 do not extend beyond the vertical line passing through the midpoint of the semi-circle forming receiving channel 25. Thus roller lips 26 will not extend beyond the midpoint of tubular workpiece 99 when the workpiece 99 is positioned within the receiving channel 25. Lateral rollers 15 are mounted onto post members 17 such that they are free to rotate during the bending process. Post members 17 are fixed in position in slots 16 by any suitable mechanical fastening means, such as a threaded nut, for example, which allow the lateral rollers 15 to be adjusted to the proper location along the slots 16 and then locked in place during the bending operation.

Referring now to FIGS. 3, 4 and 5, the configuration and structure of the bending shoe 11 may be seen in more detail. Bending shoe 11 has a curved workpiece meeting face 21 on its forward portion which presses the workpiece 99 against the lateral rollers 15 during the bending operation. The tubular workpiece 99 is received within a bending channel 22 which is semi-circular in both vertical and horizontal cross-sections. At each end of the 180 degree bending channel 22, the bending channel 22 meets one of two lateral channels 23 for receiving the workpiece 99. Each lateral channel 23 is linear and its axis is parallel to the reciprocating axis 91 and to each other. The combination of the bending channel 22 with the two lateral channels 22 forms a full U-shaped channel around bending shoe 11 which receives the workpiece 99 during the bending operation. At the top and bottom of lateral channels 23, lateral lips 27 provide planar surfaces corresponding to a vertical line drawn through the midpoint of the vertical semi-circle forming lateral channel 23. Thus the lateral lips 27 on each side of bending shoe 11 do not extend beyond the semi-circle of lateral channel 23, so as not to extend beyond a vertical line passing through the midpoint of the tubular workpiece 99 being bent when the workpiece 99 is in place, as shown in FIG. 4.

As seen in FIGS. 3 and 5, however, the extended lips 24 of bending shoe 11, unlike the lateral lips 27 and roller lips 26, extend outwardly in the forward direction beyond the semi-circle of bending channel 22. During the bending operation, crimping and folding of the workpiece 99 being bent often occurs in the area of the workpiece meeting face 21. Any slight separation of the tubular workpiece 99 out of the semi-circular bending channel 22 allows the force to be transferred into the vertical direction and a fold may occur in the workpiece 99. By providing extended lips 24 extending from the top and bottom of the bending channel 22, the workpiece 99 is still constricted in the vertical direction even if slight separation occurs during the bending operation. Any extension of the lips 24 beyond the semi-circular bending channel 22 will provide for increased efficiency of the invention, but it is preferable that the extended lips 24 extend twice the radial distance of the semi-circle of the bending channel 22. This distance is equal to the full outer diameter of the tubular workpiece 99 and provides maximum containment during the bending operation.

Figure 8:
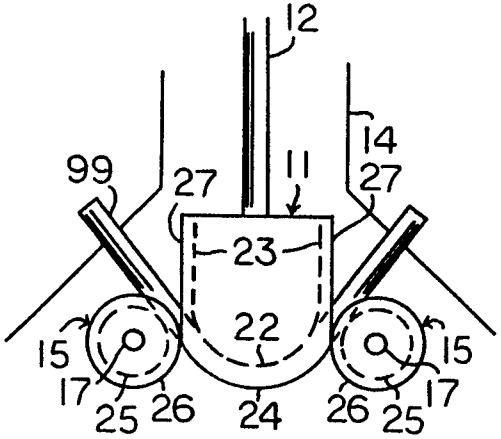
FIG. 8 is a top view of a portion of the invention in a middle bending position, showing the bending shoe, tubular workpiece and rollers.
Figure 7:
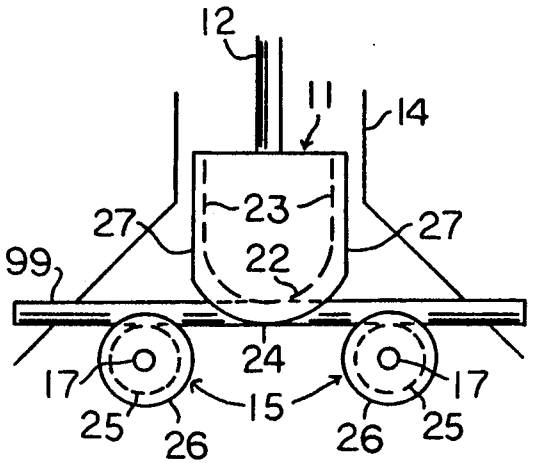
FIG. 7 is a top view of a portion of the invention in the beginning position, showing the bending shoe, tubular workpiece and rollers.

As seen in FIGS. 7, 8 and 9, the bending operation is performed by placing a workpiece 99 between bending shoe 11 and lateral rollers 15, which are fixed in place in slots 16. The reciprocating power means 13 advances the bending shoe 11, forcing the workpiece 99 against the lateral rollers 15. The workpiece 99 is held by the bending channel 22 of the bending shoe 11 and by the receiving channels 25 of each lateral roller 15. As the bending shoe 11 advances between the lateral rollers 15, the workpiece 99 is slightly compressed and begins to bend in the desired direction. When the bending shoe 11 is fully advanced in the forward reciprocating direction, the workpiece will have been bent a full 180 degrees.

As shown in FIG. 9, it is necessary that the roller lips 26 of lateral rollers 15 meet the lateral lips 27 of bending shoe 11 to completely encircle the tubular workpiece 99 to impart a full 180 degree bend. As shown in FIG. 6, the workpiece 99 will be fully encompassed between lateral channels 23 of the bending shoe 11 and receiving channels 25 of the lateral rollers 15. Lateral rollers 15 are properly positioned in slots 16 prior to beginning the bending operation in order that the lateral lips 27 of bending shoe 11 and the roller lips 26 of the two lateral rollers 15 will contact each other. It is for this reason that lateral lips 27 and roller lips 26 cannot extend beyond the semi-circle of lateral channels 23 and receiving channels 25.

In order for the two lateral rollers 15 to contact the bending shoe 11, it is necessary that extended lips 24 on the forward portion of bending shoe 11 not extend laterally beyond the lateral lips 27. In this manner extended lips 24 will not contact or interfere with the lateral rollers 15 as the bending shoe 11 is advanced. To allow for maximum extension of the extended lips 24 over the widest possible range of the workpiece meeting face 21 of the bending shoe, the extended lips 24 are preferably configured in the horizontal direction to be a portion of a circle centered on the center point of the horizontal circle forming the bending channel 22, as shown in FIG. 3. The extended lips 24 are truncated at each point of intersection with the lateral lips 27. As shown in the figures, this configuration allows extended lips 24 to extend the full diameter distance of the workpiece 99 over a significant portion of the curved workpiece meeting face 21.

In certain applications it is desirable to impart a given arc to a workpiece over a given distance. In common tube bending devices having rollers adjustable to only a finite number of predetermined positions, it is not possible to create an infinite number of bend and distance combinations. The purpose for slots 16 in this invention is to overcome this limitation. Slots 16 are preferably angled at 45 degrees to the reciprocating axis 91 and allow lateral rollers 15 to be positioned at any desired position relative to bending shoe 11. Because of this ability, a bend of any degree up to 180 degrees can be imparted into a workpiece 99 over any distance falling between the maximum and minimum separation distance of the two lateral rollers 15. The degree of bend is determined by how far forward the bending shoe 11 is advanced, and the range of the curvature is determined by the separation of the lateral rollers 15.

The above examples are by way of illustration only, and it is contemplated that equivalents and substitutions may be obvious to those skilled in the art. The full scope and definition of the invention therefore is to be as set forth in the following claims.

I claim:

1. An apparatus for bending a tubular workpiece comprising in combination a bending shoe, two lateral rollers, a reciprocating power means to advance and retract along a reciprocating axis said bending shoe between said lateral rollers such that said lateral rollers contact said bending shoe, and a base;

where each of said lateral rollers comprises an annular workpiece receiving channel, semi-circular in vertical cross-section, and roller lips on either side of said receiving channel, said roller lips forming a contacting surface between said lateral roller and lateral lips of said bending shoe, where said lateral rollers are mounted on said base such that said bending shoe may be advanced by said reciprocating power means between said lateral rollers;

and where said bending shoe comprises a semi-circular workpiece bending channel, semi-circular in vertical cross-section, two parallel lateral channels, semi-circular in vertical cross-section and parallel to said reciprocating axis, said lateral channels meeting said bending channel such that the combination of said bending channel and said two lateral channels forms a U-shaped workpiece receiving channel, and parallel lateral lips on either side of each of said two lateral channels, said lateral lips forming a contacting surface between said bending shoe and said roller lips of said lateral rollers, such that at the point of contact said lateral channel of said bending shoe and said receiving channel of said lateral roller form a circle around said tubular workpiece, and extended lips extending outwardly on either side of said bending channel to further contain said tubular workpiece, such that the combination of said bending channel and said extended lips is U-shaped in vertical cross-section, said extended lips meeting said lateral lips, where said extending lips do not contact said roller lips when said bending shoe is advanced and retracted between said lateral rollers.

2. The apparatus of claim 1, further comprising slots in said base to receive said lateral rollers.

3. The apparatus of claim 2, where said slots are positioned in said base at 45 degree angles to the reciprocating axis of said bending shoe.

* * * * *